US006385891B1

(12) United States Patent
Rabatin

(10) Patent No.: US 6,385,891 B1
(45) Date of Patent: May 14, 2002

(54) ADAPTER FOR ATTACHING SOUND SUPPRESSORS OR OTHER AUXILIARY DEVICES TO WEAPONS

(75) Inventor: Robert Rabatin, 4565 Baywood Dr., Brunswick, OH (US) 44212

(73) Assignee: Robert Rabatin, Brunswick, OH (US)

( * ) Notice: Subject to any disclaimer, the term of this patent is extended or adjusted under 35 U.S.C. 154(b) by 0 days.

(21) Appl. No.: 09/542,306

(22) Filed: Apr. 4, 2000

(51) Int. Cl.[7] ..... F41A 21/32
(52) U.S. Cl. ..... 42/79; 42/77
(58) Field of Search ..... 89/14.3, 14.4; 42/77, 79

(56) References Cited

U.S. PATENT DOCUMENTS 2,398,298 A * 4/1946 Finlay et al. ..... 89/14.4
2,922,242 A * 1/1960 Pachmayr et al. ..... 42/79
3,867,778 A * 2/1975 Preda et al. ..... 42/79
4,510,843 A 4/1985 Rabatin ..... 89/14.4

FOREIGN PATENT DOCUMENTS

FR 980854 * 5/1951 ..... 89/14.3

* cited by examiner

*Primary Examiner*—Stephen M. Johnson
(74) *Attorney, Agent, or Firm*—Emerson & Skeriotis; John M. Skeriotis

(57) ABSTRACT

An adapter for attaching sound suppressors or other auxiliary attachments, such as a grenade launcher, to a weapon having a flash suppressor mounted on the end of a gun barrel. The adapter includes an adapter pilot specific to the caliber of weapon. Interchangeable adapter pilots allow a single adapter system to be utilized on various weapons having different calibers.

5 Claims, 3 Drawing Sheets

ADAPTER FOR ATTACHING SOUND SUPPRESSORS OR OTHER AUXILIARY DEVICES TO WEAPONS

I. BACKGROUND OF THE INVENTION

A. Field of the Invention

This invention relates to the art of guns and more specifically to auxiliary attachments for the end of a gun barrel such as a sound suppressor.

B. Description of the Related Art

Previously, guns utilized sound suppressors that were directly affixed to the flash suppressor located on the end of a gun barrel. Removal of the sound suppressor also required removal of the flash suppressor leaving the threads exposed to damage during use. Additionally, a sound suppressor was dedicated to one and only one caliber because of the internal clearances. This requires a separate sound suppressor for each caliber. Precision alignment and clearances of the internal dimensions of the attachment are necessary for safe and proper use.

The present invention eliminates the need for a dedicated sound suppressor for each separate caliber of gun. The invention also provides for quick and easy connection of the attachment without the use tools. Further the invention can be utilized with a plurality of attachments. The present invention contemplates a new and improved adapter for attaching sound suppressors or other auxiliary attachments to a plurality of weapons having different calibers through the use of interchangeable adapter pilots which is simple in design, effective in use, and overcomes the foregoing difficulties and others while providing better and more advantageous overall results.

II. SUMMARY OF THE INVENTION

It is a principle object of the invention to provide an improved sound suppressor attaching device for guns which includes a removably mounted adapter that can be replaced allowing a single attachment device to be used on multiple weapons each having a different caliber. Additional auxiliary attachments can also be installed on the present invention for use in conjunction with a gun, which would include but are not limited to grenade launchers. Typical gun models utilizing such attachments would include the M-16A1, Colt AR-15, XM-231 and other similar weapons.

It is another object of the present invention to provide a sound suppressor attaching device that is simple and reliable in attaining positive locking engagement.

It is a further object of the present invention to provide a device that permits quick connection of a sound suppressor to a gun installed by hand and without the use of tools.

It is still another object of the present invention to provide a means of securing an adapter into a collet by providing a barrier, which prevents the adapter from moving within the collet during firing of the weapon.

In accordance with the present invention, there is provided an improved device for attaching a sound suppressor or other related auxiliary attachments to the end of a gun barrel that can be utilized on more than one caliber of gun. The adapter comprises a generally tubular collet including first connecting means at a first end for attaching the associated auxiliary attachment, a plurality of elongated segments at a second end of the collet with each segment separated by a slit from each other, at least one row of lug members formed on an inward side of each segment being adapted for seating in the circumferential groove of the associated flash suppressor, a cam surface formed on an outer surface of each of the segments, second connecting means positioned intermediate the first connecting means and the second end, and positioning means located within the inner periphery of the collet; a cam nut generally tubular in shape for inserting around said collet segments having connecting means at one end for connecting to the second connecting means of the collet and having a cam surface at the other end formed on an inward side of the cam nut for engaging the segments of the collet; and, an adapter pilot being selectively positioned in said collet, the adapter pilot having a hollow, open ended body defining an inner surface being circular in cross section, the body having an exterior cylindrical base formed at the first end, and an axial extension formed the second end, wherein the circumference of the base is dimensioned to engage the inner periphery of the collet and the axial extension is dimensioned relative to a caliber of the associated weapon, the first end of the body being adapted for abutting the positioning means of the collet, and wherein the circular cross section of the first end is greater than the circular cross section of the second end.

According to another aspect of the invention, the body of the adapter pilot is a modified cone.

According to another aspect of the invention, there is provided a system for attaching auxiliary attachments to a plurality of associated weapons each having a different caliber. The system comprises a generally tubular collet including first connecting means at a first end for attaching the associated auxiliary attachment, a plurality of elongated segments at a second end of the collet with each segment separated by a slit from each other, at least one row of lug members formed on an inward side of each segment being adapted for seating in the circumferential groove of the associated flash suppressor, a cam surface formed on an outer surface of each of the segments, second connecting means positioned intermediate the first connecting means and the second end, and positioning means located within the inner periphery of the collet; a cam nut generally tubular in shape for inserting around said collet segments having connecting means at one end for connecting to the second connecting means of the collet and having a cam surface at the other end formed on an inward side of the cam nut for engaging the segments of the collet; and, a plurality of adapter pilots, wherein one of the plurality of adapter pilots is selectively positioned in said collet, the adapter pilot having a hollow, open ended body defining an inner surface being circular in cross section, the body having an exterior cylindrical base formed at the first end, and an axial extension formed the second end, wherein the circumference of the base is dimensioned to engage the inner periphery of the collet and the axial extension is dimensioned relative to a caliber of the associated weapon, the first end of the body being adapted for abutting the positioning means of the collet, and wherein the circular cross section of the first end is greater than the circular cross section of the second end.

According to another aspect of the invention, there is provided a method for attaching an auxiliary attachment to an associated weapon. The method comprises the steps of providing an adapter having a generally tubular collet including first connecting means at a first end for attachment to auxiliary attachment, a plurality of elongated segments at a second end of the collet with each segment separated by a slit from each other, at least one row of lug members formed on an inward side of each segment being adapted for seating in the circumferential groove of the associated flash suppressor, a cam surface formed on an outer surface of each of the segments, second connecting means positioned intermediate the first connecting means and the second end, and positioning means located within the inner periphery of the collet; a cam nut generally tubular in shape for inserting around said collet segments having connecting means at one end for connecting to the second connecting means of the collet and having a cam surface at the other end formed on an inward side of the cam nut for engaging the segments of the collet; and, an adapter pilot being selectively positioned in said collet, the adapter pilot having a hollow, open ended body defining an inner surface being circular in cross section, the body having an exterior cylindrical base formed at the first end, and an axial extension formed the second end, wherein the circumference of the base is dimensioned to engage the inner periphery of the collet and the axial extension is dimensioned relative to a caliber of the associated weapon, the first end of the body being adapted for abutting the positioning means of the collet, and wherein the circular cross section of the first end is greater than the circular cross section of the second end; attaching the auxiliary attachment to the first connecting means of the adapter; selectively positioning the adapter pilot into the collet through the first end of the cam nut so that the first end of the adapter pilot abuts the positioning means of the collet; positioning the cam nut over the flash suppressor; positioning the collet around the flash suppressor so that the lug members are aligned with the circumferential groove of the flash suppressor; and, engaging the connecting means of the cam nut with the second connecting means of the collet to engage the lug members into locking engagement with the circumferential groove.

According to another aspect of the invention, the collet segments are heat treated so as to possess spring-like characteristics.

According to another aspect of the invention, the device can be quickly attached to the gun by hand along with a sound suppressor that is installed directly to the present invention.

One advantage of the present invention is that one adapter system is useful to provide auxiliary attachments for weapons having different calibers.

Another advantage of the present invention is that auxiliary attachments can be placed onto a weapon without the need for specialized tools.

Other objects and advantages of the invention will be apparent to those skilled in the art upon a reading and understanding of the following description of the preferred embodiments with reference being made to the accompanying drawings.

BRIEF DESCRIPTION OF DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

The present invention is directed to an adapter for attaching a sound suppressor or other auxiliary attachment for use on a gun. The invention can be used on a plurality of weapons each having a different caliber. The weapons or guns generally possess a flash suppressor that is attached to the end of the gun barrel via screw threads. The preferred embodiment of the invention is used in combination with a "bird cage" style flash suppressor having standard dimensions known in the art wherein the flash suppressor comprises a plurality of circular grooves fashioned therein. The present invention is attached to a flash suppressor via locking engagement with the circular grooves.

Figure 1:
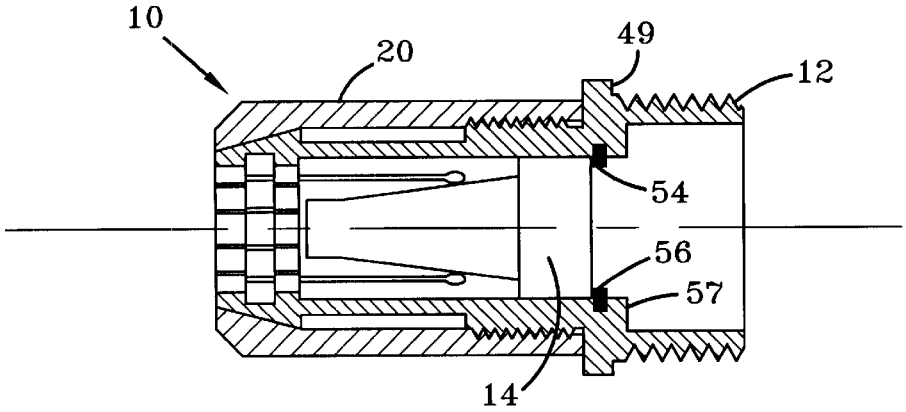
FIG. 1 depicts a side view, partly in section, of an adapter according to the present invention having each of the components operably connected.

With reference to the FIG. 1, the adapter, shown generally at 10 is comprised of three general components: a collet 12, a adapter pilot 14, and a cam nut 20. Referring to the drawings, FIG. 1 depicts a cross sectional view of the individual components in a fully assembled arrangement. The components are manufactured from a grade of steel commonly used in manufacturing weapons or any material that is chosen with sound engineering judgement such as would be appropriate for military use. The adapter pilot 14 may also be formed of aluminum or other light weight material. In the present invention, the collet 12 and cam nut 20 may be used with various interchangeable adapter pilots 14 whose dimensions are such that a variety of weapons of different calibers may be accommodated.

Figure 2:
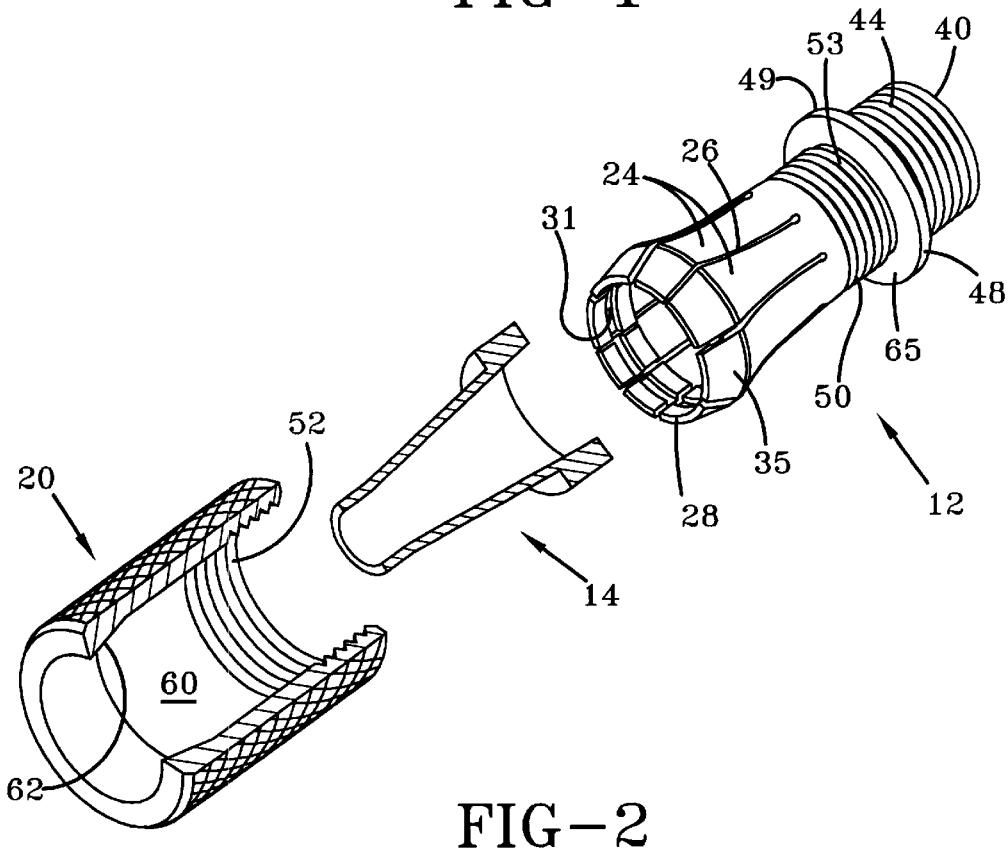
FIG. 2 is an exploded view, partly in section of the adapter shown in FIG. 1.

In the preferred embodiment the collet 12, best shown in FIG. 2, is fashioned from a single piece of material. Tubular in shape, the collet 12 has formed on one end a series of finger-like segments 24 longitudinally positioned next to each other around the tubular periphery and separated by slits 26. The segments 24 terminate at a first end 28 of collet 12. The opposing ends of the segments 24 blend into the main body of the collet 12 becoming a solid tubular piece. The segments 24 are heat-treated to effectively function like leaf springs, which can be resiliently compressed to engage a row of lug members 31. The lug members 31 are positioned in an annular fashion around the inner periphery of the segments 24 and protrude radially inward forming a set of lugs. Two sets of lugs members 31 are fashioned in the preferred embodiment although alternate embodiments may include a fewer or greater number of rows, the number of which being chosen with sound engineering judgement. In an alternate embodiment certain segments 24 may be exempt from having lug member(s) 31 fashioned on its respective inner surface as chosen with sound engineering judgement. The lug members 31 and segments 24 form a continuous piece. A cam surface 35 is fashioned on each of the outward surfaces of the segments 24 whereby the segments are depressed and the corresponding lug members 31 are pressed into locking engagement with the grooves of the gun barrel flash suppressor when the cam nut 20 is employed, as will be explained in further detail below. In the preferred embodiment, the cam surface 35 is angled approximately 15°.

Referring now to the second end 40 of collet 12, a connecting means for connecting the auxiliary attachments (not shown) to the adapter 10 is fashioned into the collet 12. In the preferred embodiment the connecting means is a first threaded section 44, which is disposed on the outward surface of collet 12 for respectively mating with matching female threads formed within an auxiliary attachment. A stop collar 48 is fashioned adjacent to the threaded section 44. Stop collar 48 has a larger diameter than the first threaded section 44. One face 49 of stop collar serves to limit the advance of any auxiliary attachment to be threaded thereon. In the preferred embodiment, the stop collar 48 is integrally formed with collet 12. However, other stopping means may be employed within the scope of the present invention.

Intermediate the first and second ends of the collet 12, there is provided a second threaded section 50. The second threaded section 50 is dimensioned for engagement of internal threads 52 of cam nut 20. In the preferred embodiment, a locking plug 53 made of nylon or other suitable material chosen with sound engineering judgement is placed into a hole arranged perpendicular to the longitudinal axis. When the adapter 10 is installed onto the gun and thereafter discharged, pressure from the bullet gases is forced against the locking plug 53, which in turn is forced against the cam nut threads 52 preventing the cam nut 20 from loosening.

The collet 12 includes positioning means 54 for positioning the adapter pilot 14. In the preferred embodiment, the positioning means includes a stop ring 56 which is held within a groove 57 formed in an inner periphery of the collet 12 near the second end thereof. Alternately, the positioning means 54 may be integrally formed with the collet 12, although ease of machining makes the groove 57/stop ring 56 combination a more preferable choice. As shown in FIG. 1, a first end of the adapter pilot 14 abuts the positioning means 54 when the adapter 10 is operably assembled.

With continued reference to FIG. 2, the interior surface 60 of the cam nut 20 includes a cam surface 62. The cam surface 62 extends from a first end of the cam nut 20 and has a minimum inner diameter dimensioned to fit over the flash suppressor. The cam surface 62 is sloped and extends axially a distance compatible with the cam surfaces 35 of collet segments 24. The cam surface 62 terminates into a straight cylindrical bore, which further terminates into an internally threaded region comprising threads 52. Functionally, the cam nut 20 is secured around the collet 12 to engage the threads 52 to second threaded region 50. This action causes cam surface 62 to press against the cam surfaces 35 forcing the segments 24 and lug members 31 radially inward. When the adapter 10 is functionally positioned on the flash suppressor, the lug members 31 engage the grooves of the flash suppressor (not shown in this view) creating a positive locking engagement. Further tightening of the threads aligns the collet 12 with the gun barrel opening. A second face 65 of the stop collar 48 limits the advancement of the cam nut 20 onto the collet 12. In the preferred embodiment the outer surface of the cam nut 20 is knurled for improved handling of the cam nut 20 as it is being installed or detached from the gun barrel flash suppressor. Thus no tools are required to mount the adapter 10. Although FIG. 2 shows an exploded view of the adapter 10, it should be noted that the action of the segments 24 when the cam nut 20 is loosened will maintain the cam nut 20 in contact with collet 12. The adapter pilot 14, however, can pass through the first end of the cam nut 20 for easy replacement thereof.

Figure 3:
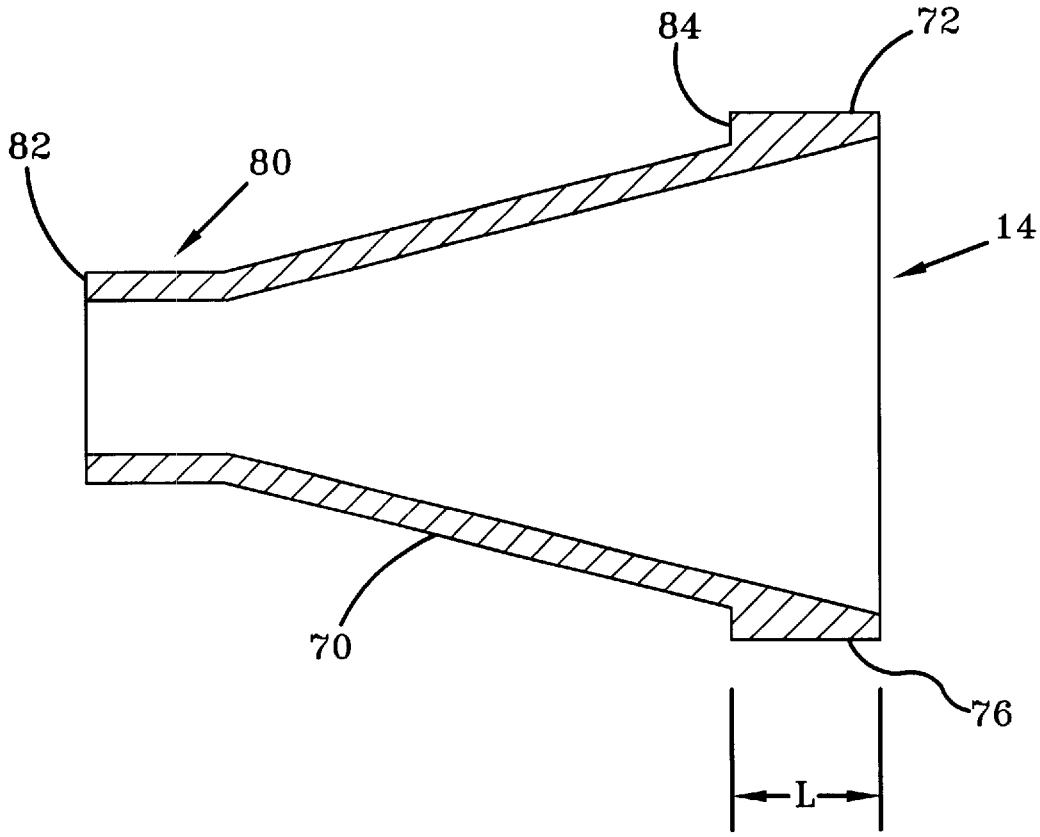
FIG. 3 is a cross-sectional view of an adapter pilot according on the present invention; and, FIG. 4 is a partial side view, partly in section, showing the positioning of a collet and an adapter pilot relative to a flash suppressor according to the invention.

With particular reference to FIG. 3, the features of the adapter pilot 14 will be set forth. The adapter pilot 14 comprises an open-ended body 70 preferably formed into a hollow modified cone having an external cylindrical base 72 at a first end 76 and an axial extension 80 at a second end 82. The body 70 of the adapter pilot 14 is dimensioned to fit within collet 12. Any contour of the adapter pilot 14 may be chosen with sound engineering judgement such that the surface does not interfere or come in contact with the movement of the segments 24. As clearances between the assembly of the present invention and the gun barrel (not shown in this view) are critical to the firing of the weapon, alignment of the adapter pilot 14 to the collet 12 and further alignment of the collet 12 to the end of the gun barrel are essential for safe and proper firing of the weapon. The base 72 of the adapter pilot 14 has an outer diameter compatible with an internal diameter of the collet 12 and a predetermined length, L, that is sufficient to provide coaxial alignment of the adapter pilot 14 within the collet 12. The base 72 includes a surface 84 disposed generally perpendicular to the longitudinal axis.

At the second end 82 of the adapter pilot 14 there is a cylindrical axial extension 80. The inner diameter of the axial extension 80 is related to a specific caliber of gun. The inner diameter maintains a minimal clearance over the inner diameter of the gun barrel (shown in phantom lines in FIG. 4) for providing a clear trajectory of the bullet from the end of the gun barrel through the axial extension 80, the remainder of the body 70 and thereafter into any auxiliary attachments. In the preferred embodiment, the inner diameter of the adapter pilot 14 generally enlarges uniformly from the axial extension 80 to the opposite end of the body 70. However, any contour of the inner surface of the adapter pilot 14 may be chosen with sound engineering judgement. As bullet gases are expelled from the trailing the edge of the bullet and traverse through the interior of the adapter pilot 14, the adapter pilot 14 shields the collet segments 24 from the extreme temperatures created therein.

The adapter pilot 14, is selectively positioned in the collet 12 to allow for quick replacement with an alternate adapter pilot (not shown) having dimensions relative to an alternate caliber weapon.

Figure 4:
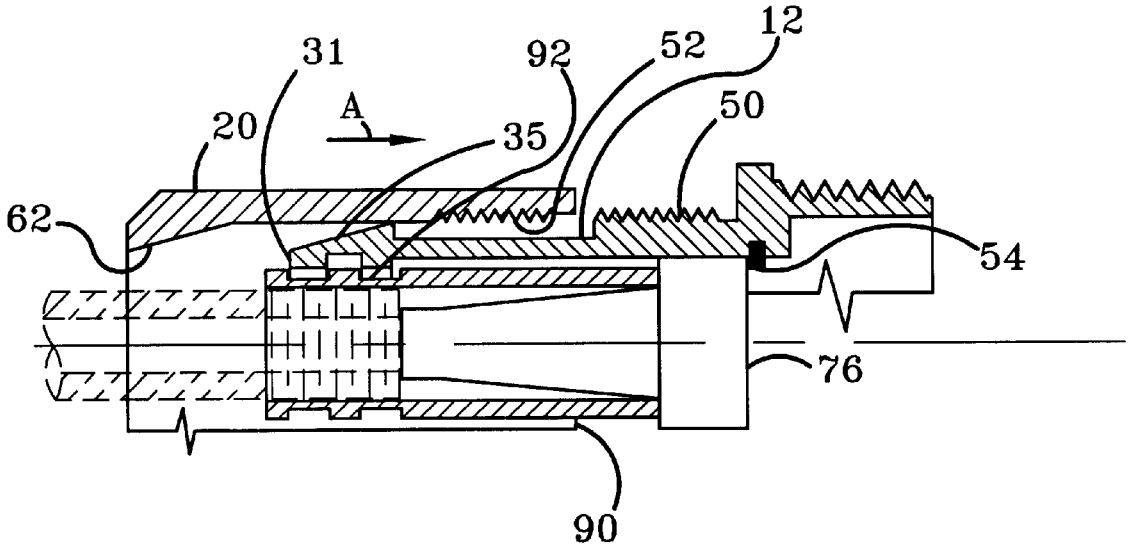

With particular reference to FIG. 4, installation of the present invention onto the end of a gun barrel flash suppressor 90 is as follows. An adapter pilot 14, chosen to match the caliber of weapon, is inserted through the first end of the cam nut 20 and positioned in the collet 12 so that the first end 76 of adapter pilot 14 abuts the positioning means 54. The first end of cam nut 20 is then inserted over the gun barrel flash suppressor 90. The collet 12 is positioned around the gun barrel flash suppressor 90 such that the lug members 31 reside directly over the circular grooves 92. The cam nut 20 is then slid in the direction of arrow A and threads 52 are engaged into the second threaded region 50. This action causes cam surface 62 to contact cam surface 35 and thereby engage the sets of lug members 31 into locking engagement with the circular grooves 92.

In order to use the adapter 10 on a weapon of different caliber, the cam nut 20 is loosened and slid in a direction opposite to arrow A. When the collet is disengaged from the flash suppressor 90, the adapter 10 can be removed from the end of the gun barrel, shown in phantom lines. The adapter pilot 14 is removed through the first end of the cam nut 20, and an appropriate alternate adapter pilot (not shown) is inserted as above. The adapter 10 is then positioned on the weapon as directed above.

Thus it can be easily seen that the adapter 10 can be utilized on a plurality of weapons having a range of calibers simply by replacing the adapter pilot 14. The adapter 10 can also be easily dimensioned to fit all sizes of military weapons currently in use. Additionally the use of tools is not required for installation of the device. Military personnel in the field are therefore not required to carry extra equipment but by merely applying hand power can quickly attached and detach a sound suppressor or other auxiliary attachment from the weapon through the employment of the present invention. Further, it can be seen that apart from the interchangeable adapter pilot 14, there are no loose parts that can be lost. The collet 12 remains connected to a sound suppressor or other auxiliary device by threads 36 and the cam nut 20 is retained on the collet 12 by outward spring tension of the segments 24 pressing against the inside bore of the cam nut 20.

While specific embodiments of the invention have been described and illustrated, it is to be understood that these embodiments are provided by way of example only and that the invention is not to be construed as being limited thereto but only by proper scope of the following claims.

What is claimed is:

1. A system for connecting an auxiliary attachments to an associated weapon, the weapon including a flash suppressor mounted to an end of a gun barrel and having at least one circumferential groove formed in an outer surface thereof, the system comprising:

a generally tubular collet including first connecting means at a first end for attaching the auxiliary attachment, a plurality of elongated segments at a second end of the collet with each segment separated by a slit from each other, at least one row of lug members formed on an inward side of each segment being adapted for seating in the circumferential groove of the flash suppressor, a cam surface formed on an outer surface of each of the segments, second connecting means positioned intermediate the first connecting means and the second end, and positioning means located within the inner periphery of the collet;

a cam nut generally tubular in shape for inserting around said collet segments having connecting means at one end for connecting to the second connecting means of the collet and having a cam surface at the other end formed on an inward side of the cam nut for engaging the segments of the collet; and, an adapter pilot being selectively positioned in said collet, the adapter pilot having a hollow, open ended body defining an inner surface being circular in cross section, the body having an exterior cylindrical base formed at the first end, and an axial extension formed the second end, wherein the circumference of the base is dimensioned to engage the inner periphery of the collet and the axial extension is dimensioned relative to a caliber of the associated weapon, the first end of the body being adapted for abutting the positioning means of the collet, and wherein the circular cross section of the first end is greater than the circular cross section of the second end.

2. The device of claim 1 wherein the body of the adapter pilot is a modified cone.

3. A system for attaching auxiliary attachments to a plurality of associated weapons each having a different caliber, wherein each of the weapons includes a flash suppressor having at least one circumferential groove formed in an outer surface thereof, the system comprising:

a generally tubular collet including first connecting means at a first end for attaching the associated auxiliary attachment, a plurality of elongated segments at a second end of the collet with each segment separated by a slit from each other, at least one row of lug members formed on an inward side of each segment being adapted for seating in the circumferential groove of the associated flash suppressor, a cam surface formed on an outer surface of each of the segments, second connecting means positioned intermediate the first connecting means and the second end, and positioning means located within the inner periphery of the collet;

a cam nut generally tubular in shape for inserting around said collet segments having connecting means at one end for connecting to the second connecting means of the collet and having a cam surface at the other end formed on an inward side of the cam nut for engaging the segments of the collet; and, a plurality of adapter pilots, wherein one of the plurality of adapter pilots is selectively positioned in said collet, the adapter pilot having a hollow, open ended body defining an inner surface being circular in cross section, the body having an exterior cylindrical base formed at the first end, and an axial extension formed the second end, wherein the circumference of the base is dimensioned to engage the inner periphery of the collet and the axial extension is dimensioned relative to a caliber of the associated weapon, the first end of the body being adapted for abutting the positioning means of the collet, and wherein the circular cross section of the first end is greater than the circular cross section of the second end.

4. A method for attaching an auxiliary attachment to an associated weapon including a flash suppressor mounted onto a gun barrel, the flash suppressor having at least one circumferential groove formed in an outer surface thereof, the method comprising the steps of:

providing an adapter having a generally tubular collet including first connecting means at a first end for attachment to the auxiliary attachment, a plurality of elongated segments at a second end of the collet with each segment separated by a slit from each other, at least one row of lug members formed on an inward side of each segment being adapted for seating in the circumferential groove of the associated flash suppressor, a cam surface formed on an outer surface of each of the segments, second connecting means positioned intermediate the first connecting means and the second end, and positioning means located within the inner periphery of the collet; a cam nut generally tubular in shape for inserting around said collet segments having connecting means at one end for connecting to the second connecting means of the collet and having a cam surface at the other end formed on an inward side of the cam nut for engaging the segments of the collet; and, an adapter pilot being selectively positioned in said collet, the adapter pilot having a hollow, open ended body defining an inner surface being circular in cross section, the body having an exterior cylindrical base formed at the first end, and an axial extension formed the second end, wherein the circumference of the base is dimensioned to engage the inner periphery of the collet and the axial extension is dimensioned relative to a caliber of the associated weapon, the first end of the body being adapted for abutting the positioning means of the collet, and wherein the circular cross section of the first end is greater than the circular cross section of the second end;

attaching the auxiliary attachment to the first connecting means of the adapter;

selectively positioning the adapter pilot into the collet through the first end of the cam nut so that the first end of the adapter pilot abuts the positioning means of the collet;

positioning the cam nut over the flash suppressor;

positioning the collet around the flash suppressor so that the lug members are aligned with the circumferential groove of the flash suppressor; and, engaging the connecting means of the cam nut with the second connecting means of the collet to engage the lug members into locking engagement with the circumferential groove.

5. A device adapted for connecting associated auxiliary attachments to an associated weapon, the device comprising:

a generally tubular collet including first connecting means at a first end, a plurality of elongated segments at a second end of the collet with each segment separated by a slit from each other, at least one row of lug members formed on an inward side of each segment, a cam surface formed on an outer surface of each of the segments, second connecting means positioned intermediate the first connecting means and the second end, and positioning means located within the inner periphery of the collet;

a cam nut generally tubular in shape for inserting around said collet segments having connecting means at one end for connecting to the second connecting means of the collet and having a cam surface at the other end formed on an inward side of the cam nut for engaging the segments of the collet; and, an adapter pilot being selectively positioned in said collet, the adapter pilot having a hollow, open ended body defining an inner surface being circular in cross section, the body having an exterior cylindrical base formed at the first end, and an axial extension formed at the second end, wherein the circumference of the base is dimensioned to engage the inner periphery of the collet, the first end of the body being adapted for abutting the positioning means of the collet, and wherein the circular cross section of the first end is greater than the circular cross section of the second end.

* * * * *